US008668401B2

(12) United States Patent
Francavilla

(10) Patent No.: US 8,668,401 B2
(45) Date of Patent: Mar. 11, 2014

(54) MASCARA DISPENSING DEVICE

(76) Inventor: Frank Francavilla, Wantage, NJ (US)

( * ) Notice: Subject to any disclaimer, the term of this patent is extended or adjusted under 35 U.S.C. 154(b) by 421 days.

(21) Appl. No.: 13/080,254

(22) Filed: Apr. 5, 2011

(65) Prior Publication Data

US 2011/0243639 A1 Oct. 6, 2011

Related U.S. Application Data

(60) Provisional application No. 61/320,854, filed on Apr. 5, 2010.

(51) Int. Cl.
*B43K 5/02* (2006.01)

(52) U.S. Cl.
USPC ..... 401/188 R; 401/126; 132/218

(58) Field of Classification Search
USPC ..... 132/218; 401/188 R, 122, 126–130
See application file for complete search history.

(56) References Cited

U.S. PATENT DOCUMENTS

| | | | | |
|---|---|---|---|---|
| D158,554 | S | | 5/1950 | Cady |
| 2,637,466 | A | | 5/1953 | Wright |
| D175,548 | S | | 9/1955 | Kane |
| 3,091,374 | A | | 5/1963 | Schwartzman |
| 3,181,539 | A | * | 5/1965 | Aston ..... 401/188 R |
| 3,236,418 | A | | 2/1966 | Dalle et al. |
| 3,359,992 | A | | 12/1967 | Cishek et al. |
| 4,548,524 | A | | 10/1985 | Seager |
| 4,671,432 | A | | 6/1987 | Benecke et al. |
| 4,676,408 | A | | 6/1987 | Speitel |
| 4,685,820 | A | | 8/1987 | Kremer et al. |
| 4,722,459 | A | | 2/1988 | Goncalves |
| 4,783,185 | A | | 11/1988 | Erismann et al. |
| 4,787,911 | A | | 11/1988 | Sebag et al. |
| D299,973 | S | | 2/1989 | Campello et al. |
| D300,561 | S | | 4/1989 | Asa et al. |
| 4,874,117 | A | | 10/1989 | Kay et al. |
| 4,883,204 | A | | 11/1989 | Kay et al. |
| D306,354 | S | | 2/1990 | Konose |
| D306,355 | S | | 2/1990 | Shinohara |
| D306,914 | S | | 3/1990 | Shinohara |
| 4,981,241 | A | | 1/1991 | Keller |
| 4,991,749 | A | | 2/1991 | Kay et al. |
| 4,995,540 | A | | 2/1991 | Colin et al. |
| 5,002,415 | A | * | 3/1991 | Gueret ..... 401/126 |
| D318,538 | S | | 7/1991 | Shinohara |
| 5,096,319 | A | * | 3/1992 | Gueret ..... 401/126 |
| D325,264 | S | | 4/1992 | Shinohara |
| 5,137,388 | A | | 8/1992 | Kimura |

(Continued)

FOREIGN PATENT DOCUMENTS

| | | |
|---|---|---|
| DE | 39 37 295 A1 | 5/1991 |
| GB | 2083142 | 9/1981 |
| WO | 01/87641 | 11/2001 |

*Primary Examiner* — David J. Walczak
*Assistant Examiner* — Jennifer C Chiang
(74) *Attorney, Agent, or Firm* — Lerner, David, Littenberg, Krumholz & Mentlik, LLP

(57) ABSTRACT

A cost effective device for storing a fluid material, and controlling the amount of fluid material that will be provided on an applicator for application to a particular surface is disclosed. The device is comprised of few parts including an outer housing having a first chamber and a second chamber, a fluid insert, an applicator, and an adjustment mechanism. This makes the device cheaper to manufacture, and easy to assemble. The embodiments disclosed can be provided in a pre-assembled form to cosmetic companies and the like seeking to fill a dispenser with their fluid cosmetic products.

23 Claims, 18 Drawing Sheets

(56) References Cited

U.S. PATENT DOCUMENTS

| | | | | |
|---|---|---|---|---|
| D337,259 | S | 7/1993 | Curtis et al. | |
| 5,295,601 | A | 3/1994 | Bostelman | |
| 5,339,841 | A * | 8/1994 | Gueret | 132/218 |
| 5,411,176 | A | 5/1995 | Favre | |
| 5,423,752 | A | 6/1995 | Haber et al. | |
| D364,003 | S | 11/1995 | Benson | |
| D369,384 | S | 4/1996 | Yasoshima | |
| 5,507,401 | A | 4/1996 | Huang | |
| 5,526,960 | A | 6/1996 | Breidenbach et al. | |
| 5,586,694 | A | 12/1996 | Breidenbach et al. | |
| 5,819,988 | A | 10/1998 | Sawhney et al. | |
| 5,851,080 | A | 12/1998 | Nakajima et al. | |
| 5,938,363 | A | 8/1999 | Timms | |
| 5,997,206 | A | 12/1999 | Lin | |
| 6,016,916 | A | 1/2000 | Ortner | |
| 6,142,692 | A * | 11/2000 | Garcia | 401/122 |
| 6,176,396 | B1 | 1/2001 | Hamada et al. | |
| 6,213,661 | B1 | 4/2001 | Coon | |
| 6,234,181 | B1 | 5/2001 | Lou | |
| 6,308,862 | B1 | 10/2001 | Fillmore et al. | |
| 6,412,659 | B1 | 7/2002 | Kneer | |
| 6,419,124 | B1 | 7/2002 | Hennemann et al. | |
| 6,439,431 | B1 | 8/2002 | Breault et al. | |
| 6,446,841 | B1 | 9/2002 | Petit | |
| 6,450,720 | B1 * | 9/2002 | Cai | 401/193 |
| 6,505,983 | B1 | 1/2003 | Seo | |
| 6,530,709 | B1 | 3/2003 | Washington | |
| 6,533,482 | B1 | 3/2003 | Byun | |
| 6,554,520 | B2 | 4/2003 | Tsuchiya et al. | |
| 6,564,972 | B2 | 5/2003 | Sawhney et al. | |
| 6,592,282 | B2 | 7/2003 | Fontanet et al. | |
| 6,640,999 | B2 | 11/2003 | Peterson | |
| D523,396 | S | 6/2006 | Shiraishi et al. | |
| 7,467,908 | B2 | 12/2008 | Francavilla et al. | |
| 8,292,529 | B2 * | 10/2012 | Francavilla | 401/101 |
| 2002/0040720 | A1 | 4/2002 | Byun | |
| 2002/0074357 | A1 | 6/2002 | Karr et al. | |
| 2003/0060925 | A1 | 3/2003 | Bartholomew et al. | |
| 2003/0062379 | A1 | 4/2003 | Bartholomew et al. | |
| 2003/0071076 | A1 | 4/2003 | Tenzer | |
| 2003/0102329 | A1 | 6/2003 | Ki | |
| 2003/0121940 | A1 | 7/2003 | Ichikawa | |
| 2003/0123921 | A1 | 7/2003 | Abbas | |

* cited by examiner

MASCARA DISPENSING DEVICE

CROSS-REFERENCE TO RELATED APPLICATIONS

This application claims the benefit of the filing date of U.S. Provisional Patent Application No. 61/320,854 filed Apr. 5, 2010, the disclosure of which is hereby incorporated herein by reference.

BACKGROUND OF THE INVENTION

The present invention relates generally to a fluid dispenser assembly that is capable of being easily assembled and dispensing predetermined amounts of fluid material.

Various types of dispensers for fluids are well known in the art. Dispensers typically comprise a cartridge for holding the fluid material, as well as a spray, pump, or plunger to dispense the fluid material out of the cartridge. Some dispensers have a spray pump attached to a pump line that runs through a cartridge containing fluid material, such as perfume. When the user depresses the spray pump, fluid material flows through the line to the spray, and then onto the desired medium. Other dispensers, such as those used for caulking, have a cartridge filled with caulk, and a trigger mechanism which causes a plunger in the cartridge to push the caulk out of the cartridge.

Various improvements have been made to overcome the shortcomings of such dispensers. For example, U.S. Pat. No. 7,467,908 ("the '908 Patent"), the disclosure of which is incorporated herein by reference, discloses a fluid dispenser that has few parts, can be readily assembled, and provides only a predetermined amount of fluid material. Nonetheless, improvements can still be made to a dispenser, such as the one disclosed in the '908 Patent, to better tailor the fluid dispenser to a specific type of user application and to overcome shortcomings related to same.

SUMMARY OF THE INVENTION

The presently disclosed embodiments of fluid dispenser assemblies are designed to overcome the shortcoming of the prior art and provides improvements over such designs. In one aspect of the presently disclosed embodiments, there is a device for applying a predetermined amount of fluid material to an applicator that includes an outer housing, an adjustment mechanism, a pump, and an applicator. The outer housing may have a first chamber, a second chamber, an aperture at the second end, and a pump actuating surface between the first chamber and second chamber. An adjustment mechanism may also be constructed and arranged within the outer housing and associated with the aperture of the outer housing. The fluid insert houses fluid material. The fluid insert has a first end and a second end. A pump may be attached to the second end of the fluid insert. The applicator of the device may be insertable into the second chamber of the outer housing through the opening in the outer housing. Movement of the fluid insert relative to the outer housing causes the pump to abut the pump actuating surface of the outer housing and to discharge a predetermined amount of fluid material into the second chamber. The adjustment mechanism regulates the amount of fluid on the applicator by adjusting a relative size of the aperture so as to interfere with the applicator upon removal of the applicator from the second chamber.

In this embodiment, the adjustment mechanism may comprise an adjustment dial surrounding at least a portion of the outer housing. The adjustment dial may be positioned within at least a portion of the outer housing. The adjustment dial may be movable so as to regulate the size of the aperture of the outer housing. The adjustment dial may also include wiping edges for contacting the edges of the applicator.

In another embodiment, the adjustment mechanism may further comprises a grommet overlying the outer housing. The grommet may have an opening aligned with the opening in the outer housing. The grommet may be positioned between the adjustment dial and the outer housing.

In another embodiment, the adjustment dial may further comprise an opening aligned with the grommet, and at least a portion of the adjustment dial may be positioned within the opening of the grommet so as to adjust the size of both the opening of the grommet and the opening of the outer housing.

In an alternate embodiment, the first chamber of the outer housing is positioned adjacent the first end of the outer housing, and the second chamber is positioned adjacent the second end of the outer housing.

In another embodiment, the fluid insert is capable of being arranged within the first chamber of the outer housing.

In still another embodiment, the device further comprises a diaphragm for pushing fluid material in the fluid insert toward the pump positioned at the second end of the fluid insert.

Turning to another aspect of the presently disclosed embodiments, there is a device for applying a predetermined amount of fluid material to an applicator that includes a fluid insert for housing the fluid material, a pump a pump arranged at the second end of the fluid insert, an outer hosing having first and second interior chambers, an applicator insertable into the second chamber; and an adjustment mechanism for controlling the amount of fluid material that is on the applicator. The fluid insert may have a first end, a second end, and a protruding ridge arranged on an exterior of the fluid insert between the first end and the second end. One of the interior chambers of the housing receives the fluid insert therein. The outer housing may have a first end, a second end, a pump actuating surface positioned between the first and second ends, and an interior ridge arranged within the first chamber of the outer housing for securing the fluid insert therein when the protruding ridge of the fluid insert is positioned between the interior ridge of the outer housing and the second end of the outer housing. There may also be an adjustment mechanism for controlling the amount of fluid material that is on the applicator. The fluid insert may be constructed and arranged to be movable within the first chamber of the outer housing between a stationary position and an actuated position, the pump being in an extended position when the fluid insert is in the stationary position, and the pump being in a retracted position within the pump body as a result of the pump being in engagement with the pump actuating surface of the outer housing when the fluid insert is in the actuated position. The pump may be operative to dispense a predetermined amount of fluid material into the second chamber as the fluid insert is moved from the stationary position to the actuated position within the first chamber of the outer housing.

In an alternate embodiment, the first interior chamber of the outer housing is positioned adjacent the first end of the outer housing, and the second interior chamber is positioned adjacent the second end of the outer housing.

In another embodiment, the adjustment mechanism further comprises an adjustment dial overlying at least a portion of the first end of the outer housing. The adjustment dial may further includes wiping edges that can interfere with the applicator upon removal of the applicator from the second interior chamber, so as to regulate the amount of fluid material on the applicator.

In another embodiment, the adjustment mechanism further includes an opening and the outer housing includes an opening, wherein the opening of the adjustment mechanism and the opening of the outer housing are aligned.

In another embodiment, the opening of the outer housing is positioned at the second end of the outer housing.

In still another embodiment, the adjustment mechanism further comprises a grommet positioned between the outer housing and the wiper dial, the grommet having an opening aligned with an opening in the outer housing. The grommet and adjustment dial may cooperate to regulate the amount of fluid material on the applicator. At least a portion of the adjustment dial may be movable within the grommet, the at least a portion of the adjustment dial capable of increasing or decreasing the size of the opening of the grommet.

For a better understanding of the invention and to show how it may be performed, embodiments thereof will now be described, by way of non-limiting example only, with reference to the accompanying drawings.

Turning to another aspect of the presently disclosed embodiment, a device for dispensing a predetermined amount of fluid material to an applicator includes an outer housing having first and second ends, a first interior chamber, and a second interior chamber. The first interior chamber may be adjacent the first end, and the second interior chamber may be adjacent the second end. The first interior chamber includes a first ridge and a second ridge displaced from the second end, and a recessed portion positioned between the first and second ridges. There is also a fluid insert for housing fluid material. The fluid insert may have a raised ridge on a surface thereof, the fluid insert being constructed and arranged to fit within the first chamber of the outer housing so that the raised ridge can be arranged between the first and second ridges. The fluid insert may be movable from a first position to a second position within the outer housing to disperse fluid material into the second interior chamber. The fluid insert is in a first position when the raised band is adjacent to the first ridge of the fluid insert, and the fluid insert is in a second position when the raised band is adjacent to the second ridge of the fluid insert. There is also an adjustment mechanism for regulating the amount of fluid material that is provided on the applicator. The adjustment device may include an adjustment knob and a grommet, wherein the adjustment knob and grommet cooperate to regulate the size of the opening of the outer housing. The fluid insert may dispense a predetermined amount of fluid material contained in the fluid insert into the second interior chamber when the fluid insert moves from the first position to the second position.

In another embodiment, the applicator may be positioned within the first interior chamber. The applicator may be capable of applying the fluid material to a surface.

In another embodiment, the adjustment knob includes an opening that is aligned with an opening of the grommet. The adjustment knob may be capable of moving from a first position to a second position. A first length of the adjustment knob may be positioned within the opening of the grommet when the adjustment knob is in the first position. A second length of the adjustment knob may be positioned within the grommet when the knob is moved to a second position. The second length may be greater in size than the first length. The adjustment knob may therefore increase the size of the opening of the grommet when the adjustment knob moves from the first position to the second position. The adjustment knob may be rotated about the outer housing to move the adjustment knob from the first position to the second position.

DETAILED DESCRIPTION

Figure 1:
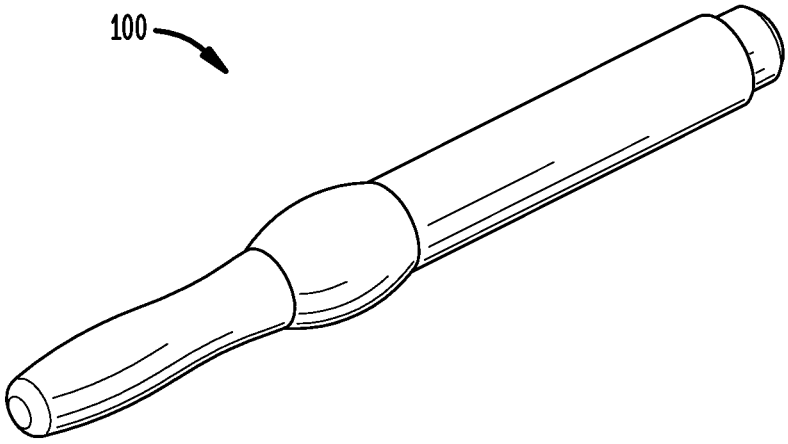
FIG. 1 is a fluid dispenser assembly in accordance with an embodiment of the present invention.

A dispenser assembly 100 is shown in FIG. 1 for dispensing predetermined amounts of fluid material and providing the user with greater control over the precise location the fluid material is to be dispensed. As shown, the dispenser assembly may have a generally cylindrical shape with curved edges, although the dispenser may take on a variety of alternate shapes that may be desired by a user, such as rectangular, triangular, etc. Some of the improvements made to the dispenser, as compared to prior art dispensers, includes the location that fluid material is stored and then dispensed from the outer casing, the ability of the user to more precisely apply the fluid material dispensed from the fluid dispenser, and the ability to help prevent clumping of materials on the applicator.

As will be discussed in more detail herein, fluid material housed within the fluid dispenser assembly can be expelled within the interior portion of the outer casing, or into the interior portion of the outer casing, such that the fluid material is not immediately exposed to the air exterior to the outer casing. This is in contrast to the '908 Patent, wherein the fluid material is expelled through an opening at the end of the outer casing and immediately exposed to the air exterior to the outer casing. The presently disclosed embodiments also provide a separate applicator wand tip, as opposed to the prior art embodiments, wherein the applicator tip was integrally formed within the outer casing or formed at an end of the outer casing.

Figure 2:
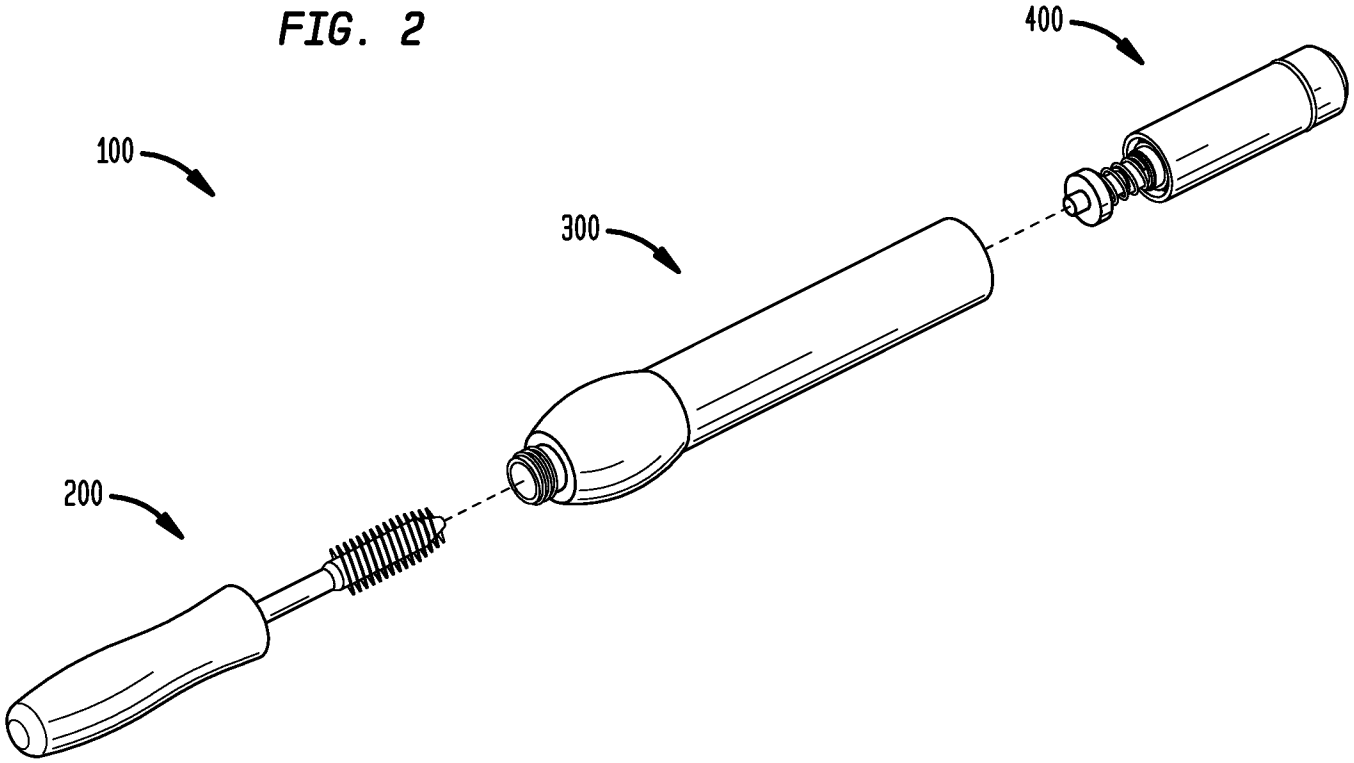
FIG. 2 is an exploded view of the fluid dispenser of FIG. 1.
Figure 3:
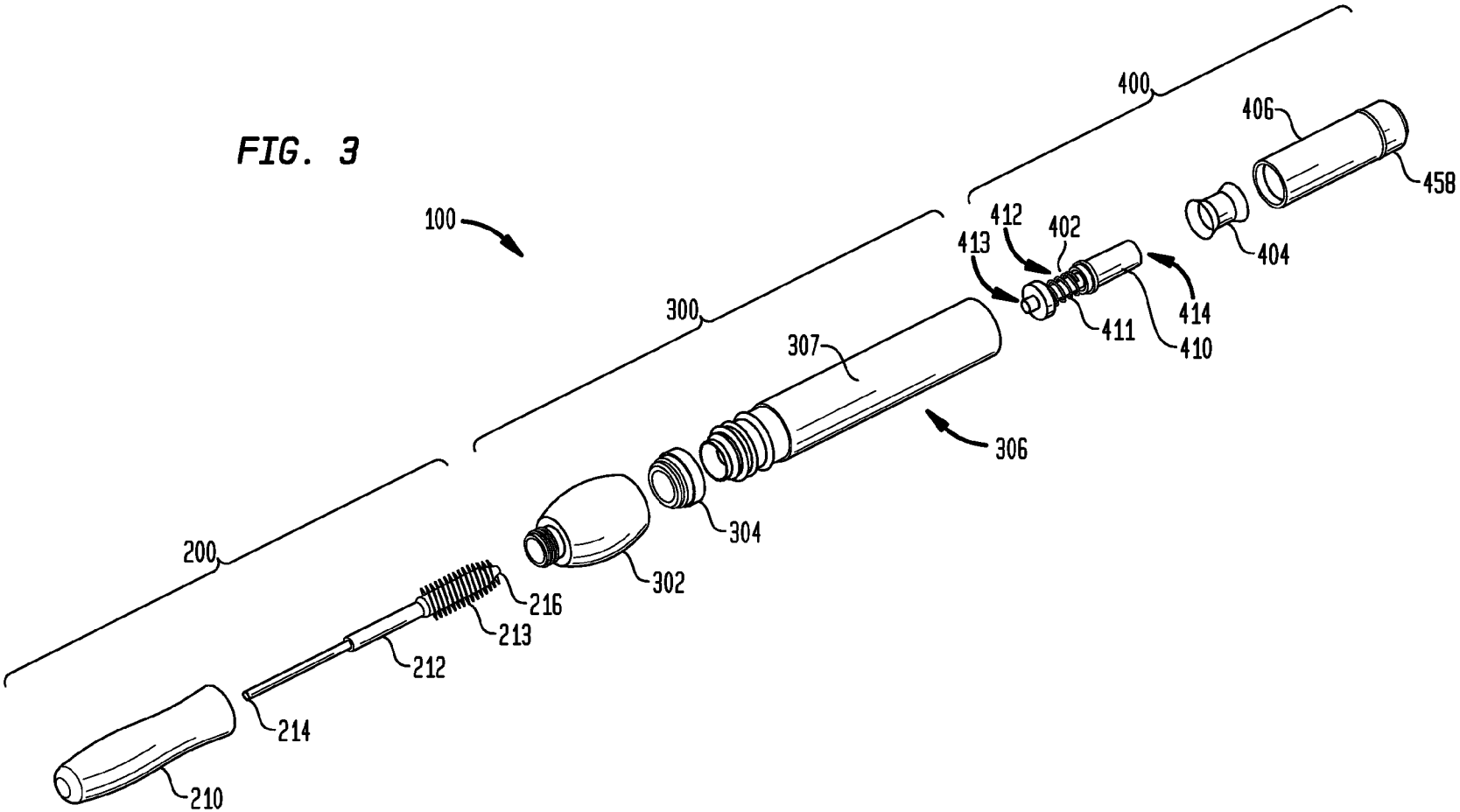
FIG. 3 is an exploded view of each of the individual components of FIG. 2.
Figure 5:
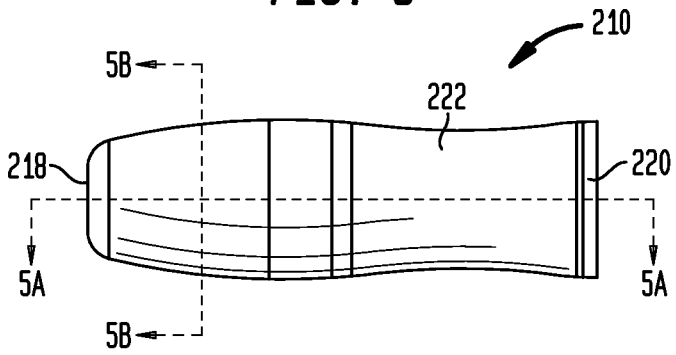
FIGS. 5-5D are views of the end cap of FIG. 2 in accordance with an embodiment of the present invention.
Figure 5A:
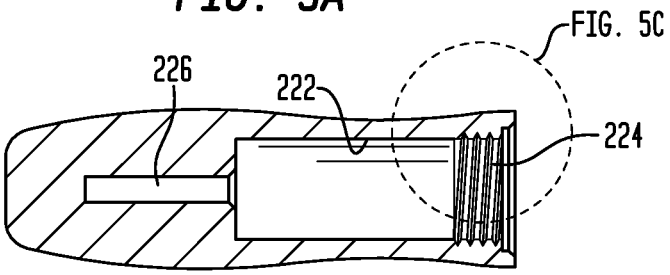
Figure 5B:
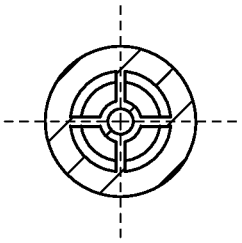
Figure 5C:
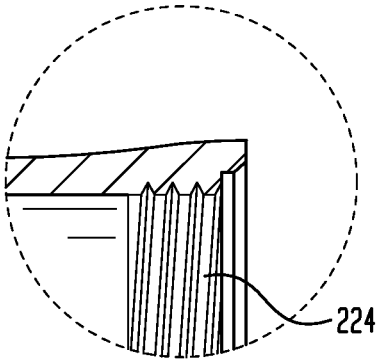
Figure 5D:
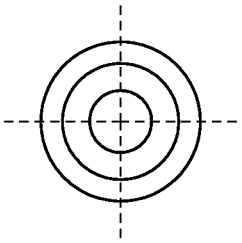

Referring to FIG. 2, the dispenser assembly may preferably be comprised of three primary components: an applicator 200, an outer casing 300, and a fluid insert 400. Turning now to FIG. 3, an exploded view of each of the three primary components of the dispenser assembly is shown. Turning first to the applicator 200, the applicator includes an end cap 210, as well as an applicator wand 212 having a brush 213 that further includes a cap connecting end 214 and an applicator tip end 216. As best shown in FIGS. 5-5D, the end cap 210 may include an exterior cap end 218 and an interior cap end 220. The interior surface 222 of the end cap 210 may include grooves (FIGS. 5A, 5C) extending around a portion of the interior surface adjacent the interior cap end 220. The interior surface 222 of the end cap 210 may further include a channel 226 (FIG. 5A) that has a diameter large enough to receive the cap connecting end 214 (FIG. 3) of the applicator wand 212.

When the applicator 200 is assembled together, the cap connecting end 214 of the applicator wand 212 can be secured within the channel 226 of the end cap 210. The brush 213 may be a traditional form of a brush, such as a mascara brush, but other forms of brushes may be utilized. Additionally, instead of the brush 213, the applicator wand 212 may take on numerous other forms that will aid in the application of a cosmetic, pharmaceutical cream, or the like to a surface, such as a sponge applicator.

Figure 6:
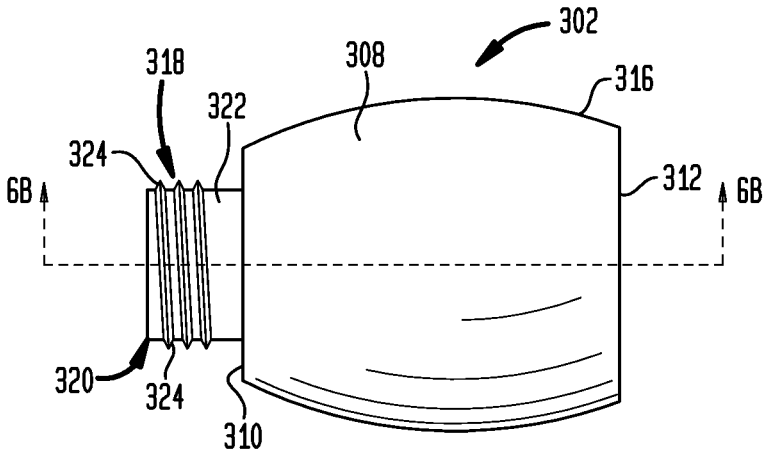
FIGS. 6-6D are views of the wiper dial of FIG. 2 in accordance with an embodiment of the present invention.
Figure 6A:
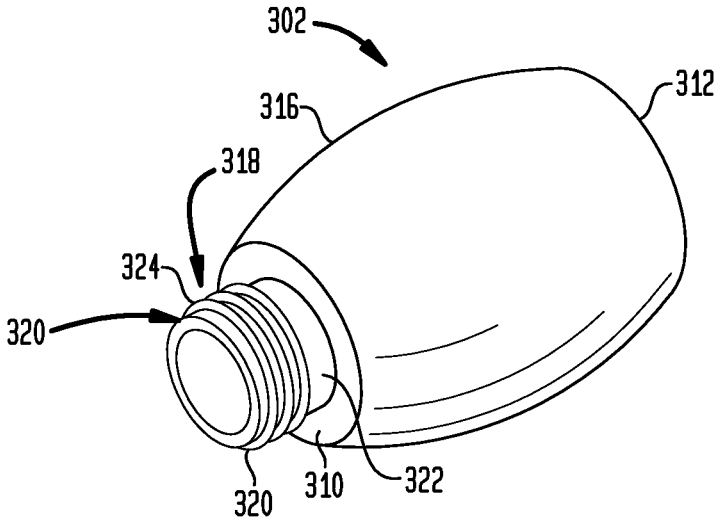
Figure 6B:
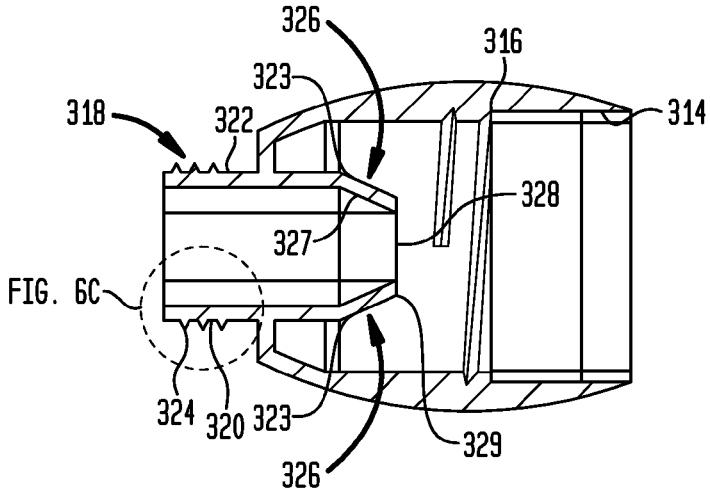
Figure 6C:
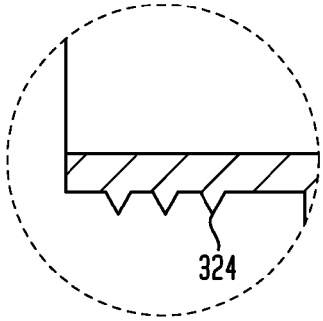
Figure 6D:
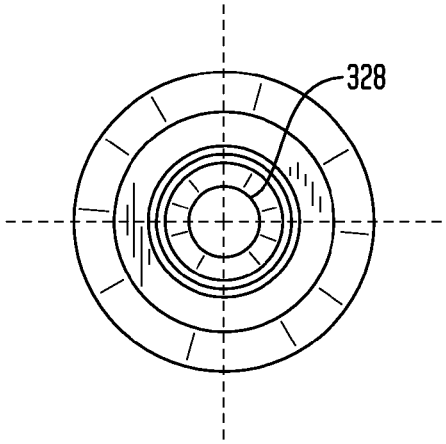

Referring back to FIG. 3, the outer casing 300 of the fluid dispenser assembly 100 may includes, a wiper dial 302, a grommet 304, and a dispensing chamber 306. FIGS. 6-6D illustrate an embodiment of the wiper dial 302 having a body 308 with an applicator end 310 and a grommet receiving end 312. As shown in FIGS. 6-6B, the outer surface 316 of the body 308 is generally curved and the interior surface 314, also curved, may have grooves 316 formed therein.

An end cap connecting portion 318 of the wiper dial 302 may extend outwardly from the applicator end 310. The end cap connecting portion 318 may have an exposed end 320 with an outer surface 322. As best shown in FIGS. 6B and 6C, grooves 324 may be constructed and arranged to extend around the outer surface 322 of the end cap connecting portion 318 and to cooperate with the grooves 224 (FIGS. 5A, 5C) on the interior surface 222 of the end cap 210 (FIGS. 5A, 5C) of the applicator 200. As best seen in FIGS. 6B and 6D, the end cap connecting portion 318 of the wiper dial 302 may also extend into at least a portion of the body 308 of the wiper dial 302 and may terminate at a tapered end 326. The tapered end 326 may form a preferably circular opening 328 with an edge 329 that can help to scrape away excess amounts of fluid material that may be deposited onto the applicator wand 212, as will be discussed in more detail herein. The tapered end 326 has an outer surface 323.

Figure 7:
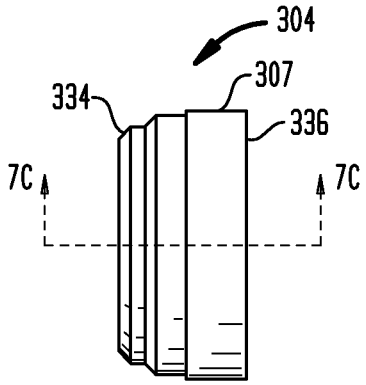
FIGS. 7-7E are views of the grommet of FIG. 2 in accordance with an embodiment of the present invention.
Figure 7A:
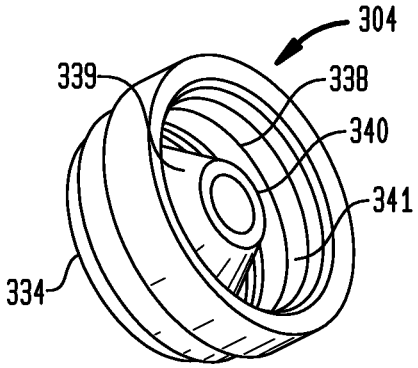
Figure 7B:
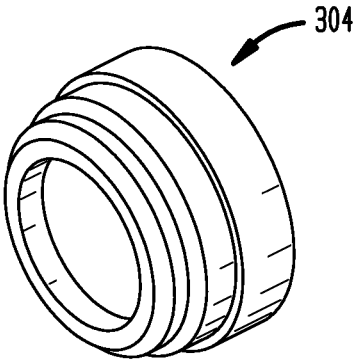
Figure 7C:
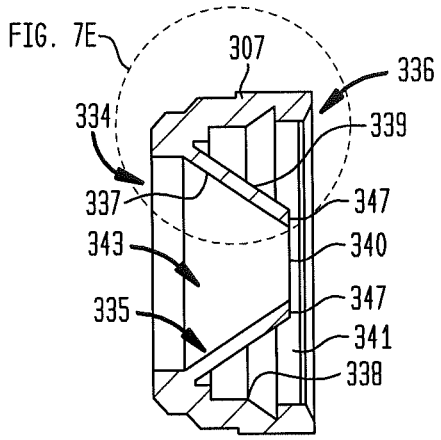
Figure 7D:
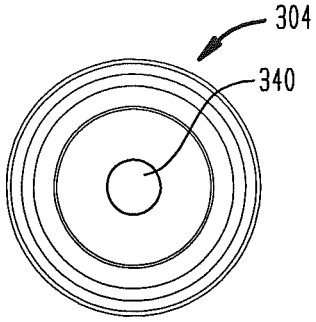
Figure 7E:
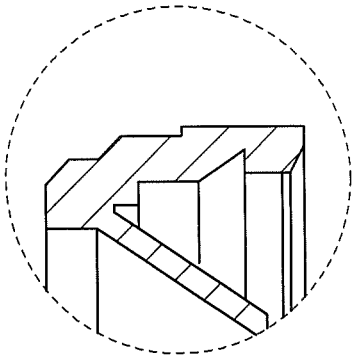

Turning now to FIGS. 7-7E, the grommet 304 of the outer casing 300 may have a generally circular body with a wiper dial receiving end 334 and a dispensing chamber receiving end 336. As best shown in FIGS. 7A and 7C, the grommet 304 may have a tapered wall 335 that tapers inwardly from the wiper dial receiving end 334 toward its dispensing chamber receiving end 336. The tapered wall has a top surface 337 and a bottom surface 339. The tapered wall 335 terminates in a preferably circular opening 340, such that the grommet has a funnel-shaped entrance 343. (FIGS. 7A, 7C). The circular opening has an edge 347 that can scrape away excess material on an applicator wand. The interior surface 341 of the grommet 304 also preferably has grooves 338. The grommet 304 is preferably formed from a flexible material, such as rubber, although other alternative materials known in the art, such as neoprene, silicones, or other flexible materials may be used. The grommet 304 is also preferably constructed and arranged to fit within the wiper dial and over the tapered end of the body of the dispensing chamber, as will be discussed herein. It is to be appreciated that any known types of grommets may be used, and that the grommet may take on alternate designs. For example, without limitation, the grommet may have a different shaped opening, such as rectangular, semi-circular, or the like.

Figure 8:
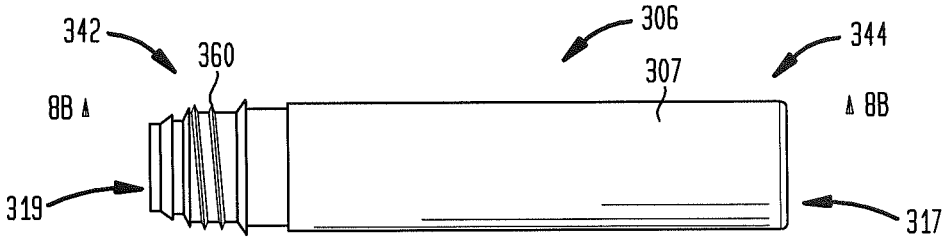
FIGS. 8-8F are views of the dispensing chamber of FIG. 2 in accordance with an embodiment of the present invention.
Figure 8A:
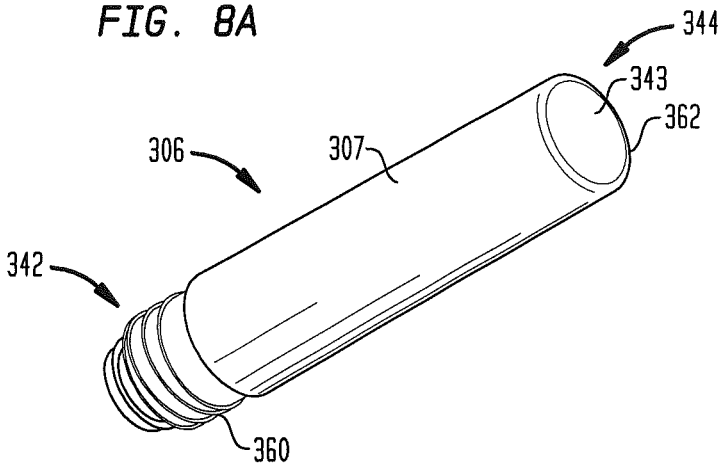
Figure 8B:
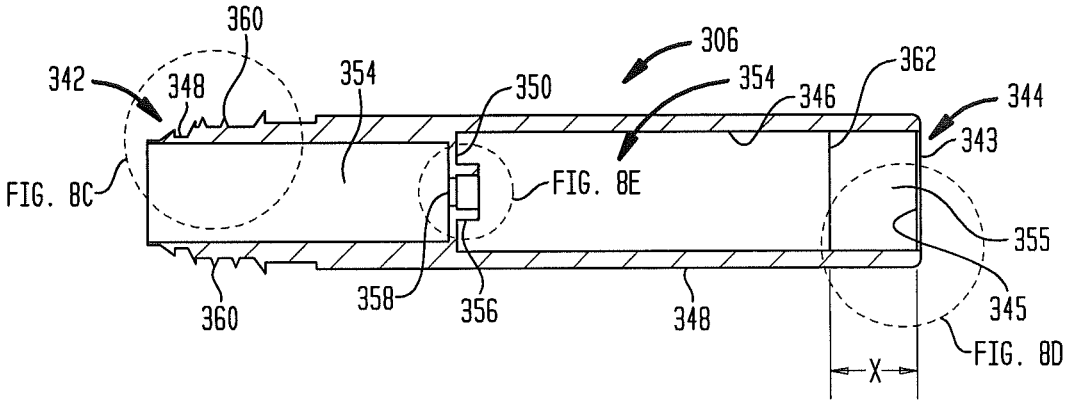
Figure 8C:
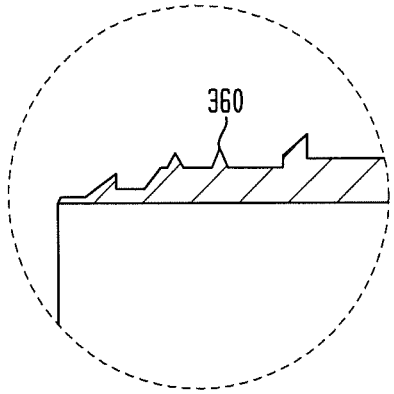
Figure 8D:
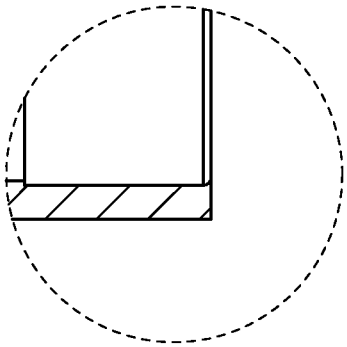
Figure 8E:
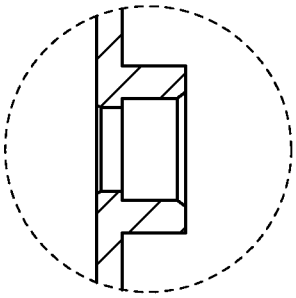
Figure 8F:
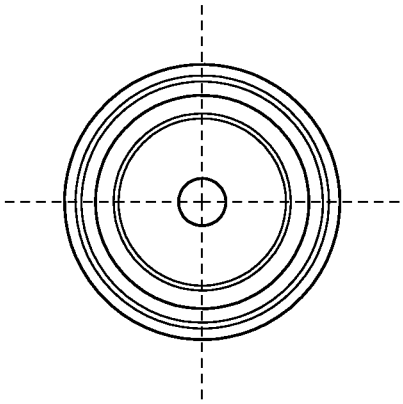

Referring now to FIGS. 8-8F, details of the dispensing chamber 306 of the outer casing 300 are shown. The dispensing chamber 306 may be considered an outer housing that may include a body 307 having a grommet receiving end 342 and a fluid insert receiving end 344. The body 307 may be generally hollow with an interior surface 346 and an exterior surface 348 that are generally cylindrical in shape. The dispensing chamber 306 has a first opening 317 at the fluid insert receiving end 344 and a second opening 319 at the grommet receiving end 342. A pump actuating surface 350 (FIG. 8B) may be positioned between the fluid insert receiving end 344 and the grommet receiving end 342, which may effectively divide the interior of the body 307 into two interior chambers: a first chamber 352 and a second chamber 354. The first chamber 352 may preferably be located closer to the fluid insert receiving end 344 the second chamber 354 may be located closer to the grommet receiving end 342. A raised circular wall 356 may extend away from the pump actuating surface 350 and an opening 358 extending through the pump actuating surface 350 may be used to expel fluid material onto the applicator wand (FIG. 3). Although not required, the circular wall 356 can help to align the pump tip 412 of the pump 402 (FIG. 3) with the opening 358 in the pump actuating surface 350.

The interior of the dispensing chamber 306 may have various diameters. As best shown in FIG. 8B, there is a pumping region 355 adjacent the fluid insert receiving end of the body 307, which is preferably recessed. The pumping region 355, which has a length X, has a diameter that is slightly larger than the remainder of the first chamber 352 of the outer casing and preferably larger than the second chamber 354 as well. The pumping region 355 may be defined as the area between the retaining ridge 343 (FIGS. 8A, 8B) and inner ridge 362. It is to be appreciated that the diameter of the first chamber 352 is also preferably larger than the diameter of the second chamber 352, although not required. The diameter of the first chamber 354 need only be large enough to accommodate the fluid insert 400 which will be inserted therein, as described in more detail herein.

As best shown in FIGS. 8B and 8C, the grommet receiving end 342 of the body 307 of the dispensing chamber 306 includes grooves 360 extending around most of the exterior surface 348 (FIG. 8B) of the grommet receiving end 342. The grooves 360 on the body 307 may be constructed and arranged to cooperate with the grooves 338 positioned on the grommet 304. As best shown in FIG. 8B, the retaining ridge 343 may extend around the interior surface of the body near the fluid insert end and the inner ridge 362 may extend around the interior surface a distance from the retaining ridge 343. The inner ridge may result from the differing diameters of the pumping region 355 and the remainder of the first chamber 354. As will be described herein, the retaining ridge 343 will help to secure the fluid insert within the outer casing and the inner ridge will prevent movement of the fluid insert 400 beyond the inner ridge 343 when the fluid insert is actuated.

Figure 4:
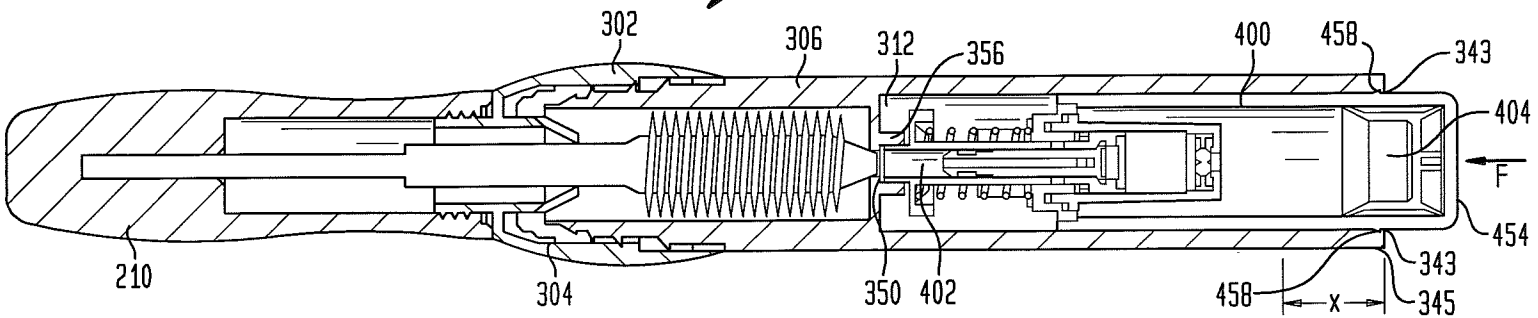
FIG. 4 is a cross-sectional view of FIG. 1.

To assemble the components of the outer casing 300 together, the grooves 338 on the interior surface 341 of the grommet 304 can be positioned over the grooves 360 extending around the exterior surface 348 of the body 307 of the dispensing chamber 306. As shown in FIG. 4, when the grommet 304 is positioned over the grooves 338 of the body 307, some grooves 360 on the body 307 remain exposed (FIG. 4). The opening 340 of grommet 304 will also be aligned with the second opening 319 of the dispensing chamber 306.

It is to be appreciated that although in this embodiment, some of the grooves 360 are utilized to facilitate attachment of the grommet 304 to the body 307, any type of methods or devices for attaching the grommet may be used. For example, the grommet 304 and/or body 307 may be attached together using numerous alternatives. For example, without limitation, either the grommet 304 or body 307 or both may include any type of surface roughenings. Alternatively, no grooves or surface roughenings may be used, and the grommet may simply be adhered to the body 307 using an adhesive material or the like, or alternatively designed so that when the grommet 304 fits over the body 307, it is readily secured to the body 307.

When the grommet is attached to the body, the wiper dial 302 can then be positioned over the grommet 304 such that the grooves 324 on the wiper dial 302 cooperate with the one or more of the remaining exposed grooves 360 on the dispensing chamber 306. The opening 335 of the wiper dial 302 will then be aligned with both the opening 340 of the grommet 304 and the second opening 319 of the dispensing chamber 307. The outer surface 323 of the tapered end 326 of the wiper dial 302 may fit into and be adjacent the top surface 337 of the grommet. Once assembled, the wiper dial 302 may be securely attached to the body of the outer casing. As with respect to the grommet, the wiper dial 302 may be attached to the grommet and body 307 of the outer casing using alternative methods or devices.

Figure 11A:
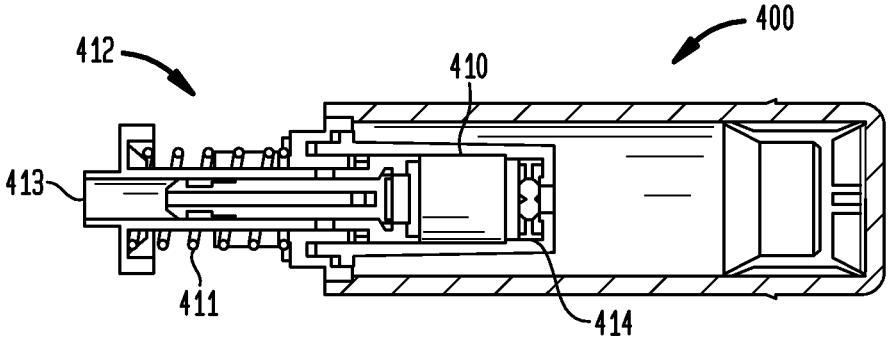
FIGS. 11A-11B are views of the assembled fluid dispenser assembly in accordance with an embodiment of the present invention.
Figure 11B:
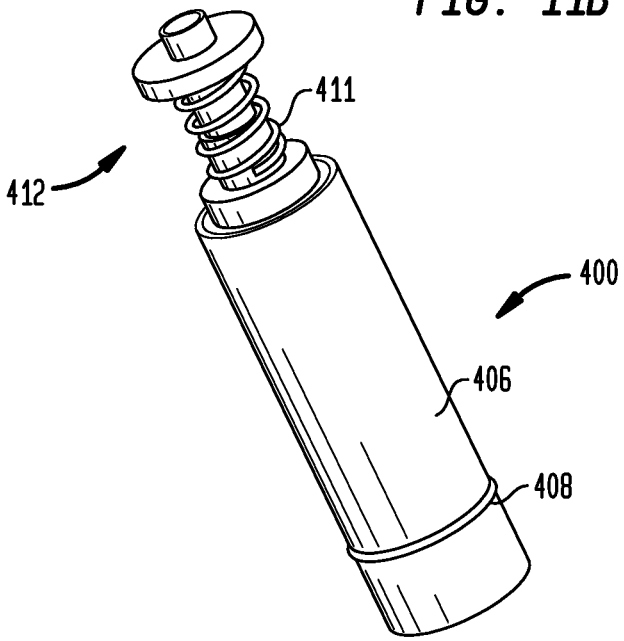

Turning now to the third primary portion of the fluid dispenser assembly 100, the fluid insert 400, FIG. 3 illustrates that the fluid insert 400 may further include a pump 402, a diaphragm 404, and a product container 406. As also shown in FIGS. 11A and 11B, the pump 402 of the fluid insert 400 includes a body 410 having an actuating end 413, a pump tip 412, a diaphragm receiving end 414 which can cooperate with the diaphragm 404, and a spring 411 extending around the pump tip 412. The pump 402 may alternatively be a standard pump with an internal check valve that is preferably capable of dispensing fluid materials of high viscosity such as those known in the art. For example, an EMSAR pump, PAV (A45) series having a 130 mcl microliter output may be utilized. It is to be appreciated that other types of pumps known in the art may also be used.

In a preferred embodiment, the pump 402 is capable of pumping fluids having a fluid viscosity ranging from at least 500 cps to 700,000 cps, although a pump capable of pumping fluids having a much lower or much higher viscosity is also contemplated. In this particular embodiment, mascara may be contained within the fluid insert, although any type of fluid material may be utilized, such as, in one example, any type of pharmaceutical composition.

Figure 9:
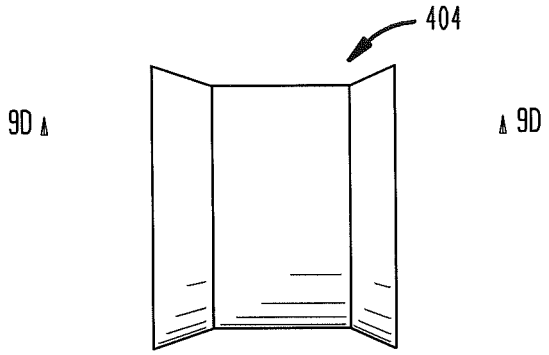
FIGS. 9-9D are views of the diaphragm of FIG. 2 in accordance with an embodiment of the present invention.
Figure 9A:
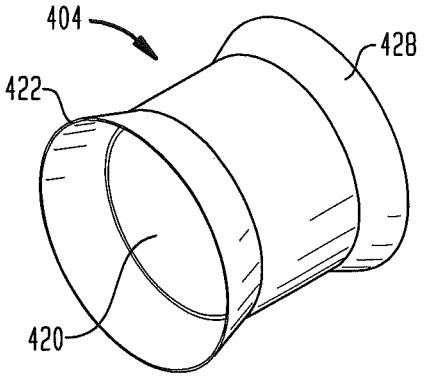
Figure 9B:
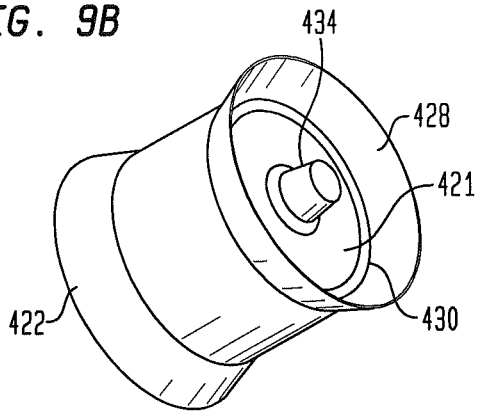
Figure 9C:
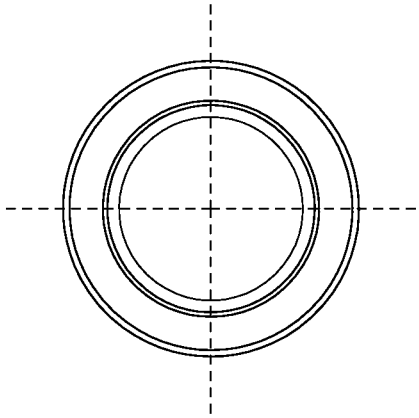
Figure 9D:
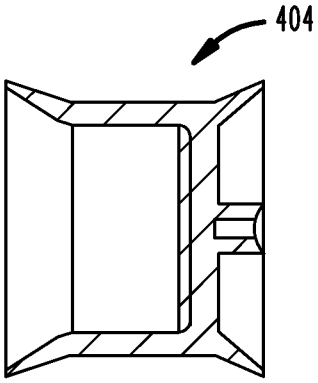

Referring to FIGS. 9-9D, the diaphragm 404 of the fluid insert 400 is shown. The diaphragm 404 preferably has a generally cylindrical body with a first outer surface 420 (FIG. 9A) and a second outer surface 421 (FIG. 9B). A first flared end 422 projects from the edge 424 of the first outer surface 420 and a second flared end 428 projects outwardly from the edge 430 of the second outer surface 421. As best shown in FIGS. 9B and 9D, a projection 434 may extend from the second outer surface 421 of the diaphragm 404. In this embodiment, the projection 434 is circular although in other embodiments, the shape of the projection 434 may vary.

Figure 10:
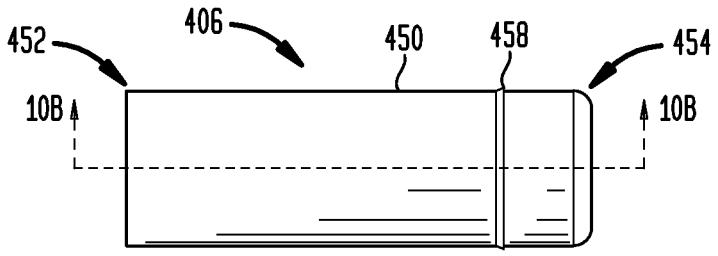
FIGS. 10-10E are views of the product container of FIG. 2 in accordance with an embodiment of the present invention.
Figure 10A:
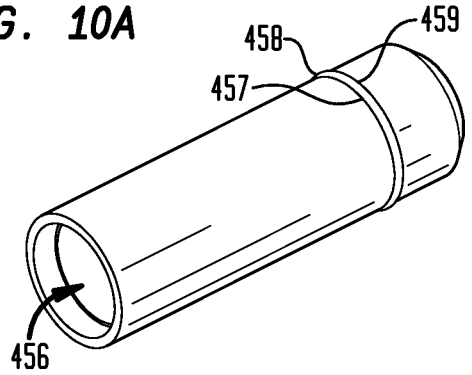
Figure 10B:
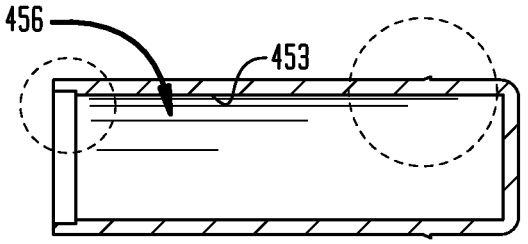
Figure 10C:
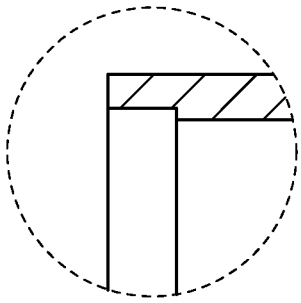
Figure 10D:
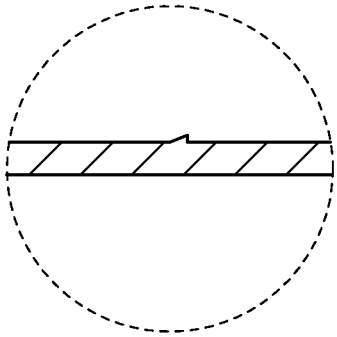
Figure 10E:
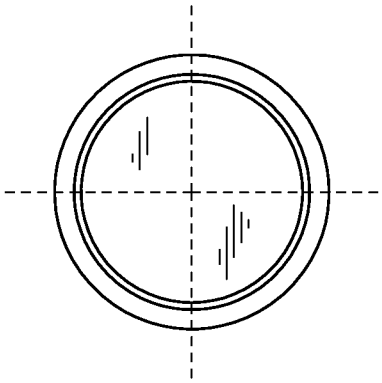

Referring to FIGS. 10-10E, the product container 406 of the fluid insert is shown having a fluid insert body 450 with an interior end 452 that has an opening and a free end 454. The product container 406 preferably has a hollow inner chamber 456 capable of storing the desired fluid material to be dispensed. A raised band 458 positioned adjacent the free end 454 extends around the outer surface 460 of the product container 406. The product container 406 preferably has a diameter that is smaller than the diameter of the body 307 of the outer casing 300, such that the product container 406 can fit within the body 307. In this embodiment, the desired fluid material is preferably provided into the interior end 452 of the free end 454 of the product container 406 prior to assembly of the pump 402. However, it is to be appreciated that the product container 406 can alternatively be designed so that the fluid material can be instead provided through the free end 454, such as providing a cap or the like adjacent the free end 454.

Referring back to FIG. 2, in order to assemble the fluid insert 400, the diaphragm 404 is placed into the product container 406, such that the second outer surface 421 (FIG. FIG. 9B) of the diaphragm 404 is facing the free end 454 of the product container 406 and the first outer surface 420 (FIG. 9B) of the diaphragm 404 is facing the interior end 452 of the product container 406. When the diaphragm 404 is positioned within the product container 406, the desired amount of fluid material can then be inserted into the product container 406. Thereafter, the pump 402 can be inserted and preferably snapped into the interior end 452 of the product container 406. The interior surface 456 of the product container 406 is essentially sealed when the pump 402 is set in place, to provide an airless chamber that will minimize unnecessary contamination of the fluid material and prolong the life of the fluid material within the product container 406.

Once the applicator 200, outer casing 300, and fluid insert 400 are individually assembled, the overall dispenser assembly 100 simply requires that these components be assembled together as one unit. In this embodiment, the fluid insert 400 fits within the body 307 of the outer casing 300. As shown in FIG. 4, the interior end 452 of the product container of the fluid insert 400 will fit within the body 307 of the outer casing 300. The pump tip 412 may preferably be aligned with the opening 358 on the pump actuating surface 350, and more specifically positioned within the area created by the raised circular wall 356. Once positioned within the outer casing 300, the band 458 extending around the outer surface of the fluid insert 400 will be positioned just below the retaining ridge 343 of the outer casing 300 to secure the fluid insert 400 within the body 307 of the outer casing 300. As shown, because the outer casing 300 includes pumping region 355, it will be possible to actuate the pump, as discussed in more detail herein.

The applicator 200 can also be assembled to the outer casing 300. The applicator wand 212 may first be inserted into the second chamber 354 of the body 307 of the outer casing 300. The applicator wand 212 will effectively pass through the aligned openings of the wiper dial 302, grommet 304, and body 307 of the outer casing 300. When the grooves 224 on the interior surface 322 of the end cap 210 are adjacent to the grooves 324 on the wiper dial 302 of the outer casing 300, the end cap 200 can be turned so that the grooves on the end cap 210 engage with the grooves 324 on the wiper dial 302 of the outer casing 300 to secure the end cap 210 to the outer casing 300. As shown in FIG. 4, when the applicator is secured to the outer casing, the tip 216 of the applicator wand 212 may extend into the opening 358 of the pump actuating surface 350 and may contact or be adjacent the pump tip 412. The pump tip 412 will be prevented from misalignment with the opening 358 of the pump actuating surface 350 by the wall 356 extending around the opening 358.

Still referring to FIG. 4, when it is desired to dispense fluid from the dispenser assembly 100, a Force F can be applied to the free end 454 of the product container of fluid insert 400. The pump tip 412 of the pump 402 of the fluid insert 400 will contact the pump actuating surface 350 of the outer casing 300 and cause the fluid insert 400 to move a short distance x (FIG. 8B) within the pumping region 355 of the outer casing 300. The movement of the fluid insert 400 causes the pump tip 412 to be partially arranged within the body of the pump 402 and the pump spring 411 to be compressed. When the pump tip 412 is retracted into the pump 402, fluid material is withdrawn from the fluid material contained in the body 410 of the pump 402 and expelled through the opening 358 in the pump actuating surface 350 of the outer casing 300. The predetermined amount of fluid material will then pass onto the applicator wand 212 for eventual use by a user. When the fluid insert 400 is in its actuated or retracted position, the lower edge 457 of the band 458 (FIG. 10A) abuts the lower edge 362 (FIG. 8B) of the pumping region 355.

When the Force F is released, the fluid insert 400 will return to its fully extended position, wherein the upper edge 459 of the band 458 (FIG. 10A) abuts the edge 345 (FIG. 4) of retaining ridge 343 on the body 307 of the outer casing 300. This is because the Force F that is transferred to the springs 411 is also released. This simultaneously causes the pump 402 to withdraw fluid material from the product container 406 of the fluid insert body 400 through small openings in the pump body 400 and to store it in the pump body 400 until another Force F is applied. It should be noted that although a user may continue to apply a Force F to the fluid insert 400, no additional fluid material will be dispensed until the Force F is released, and a new Force F is applied. In this way, only predetermined amounts of fluid materials are dispensed at any one given time.

When the fluid material is expelled through the opening 358 of the pump actuating surface 350, it deposits the fluid material into the second chamber 354 of the outer casing 300 and along at least a portion of the brush 213 on the applicator wand 212, which in this embodiment can act as a mascara brush. When a user desires to then apply the fluid material to a surface, such as eyelashes, the end cap 200 is turned so that the grooves 224 on the applicator 200 will disengage with the grooves 324 on the wiper dial 302 of the outer casing 300. As the applicator wand 212 is withdrawn from the second chamber 345 of the outer casing 300, the bristles of the brush will wipe against the edge of the grommet to help distribute the fluid material uniformly across the brush and to ensure that only an appropriate amount of mascara is on the brush 213. Once the user completes application of the mascara or fluid material, the end cap 200 can again be assembled within the outer casing 300, such that the mascara brush is ready for the next distribution and application of fluid material.

Figure 12:
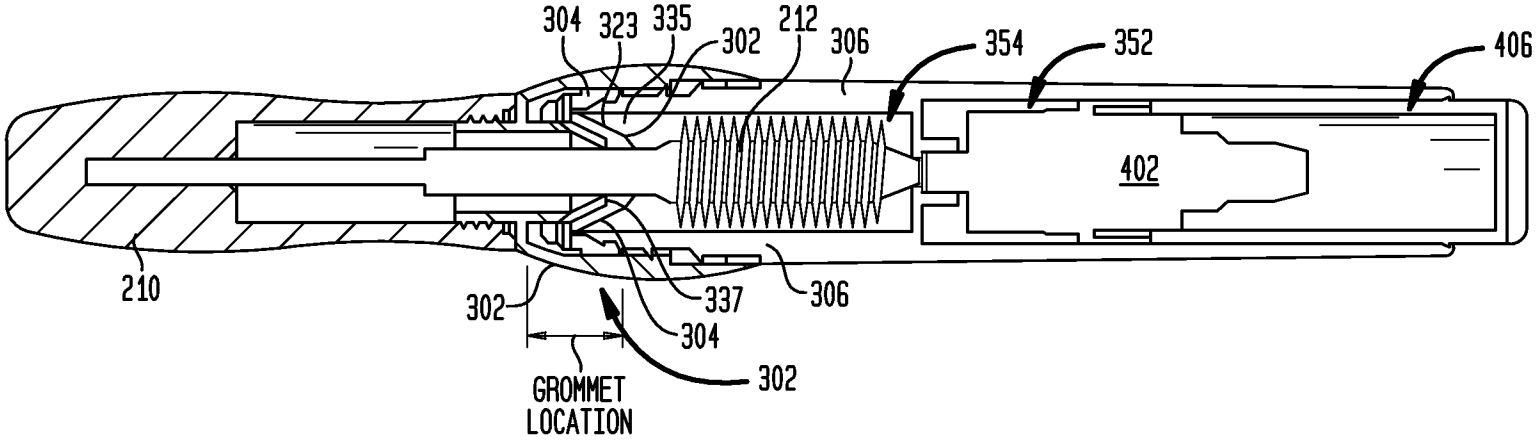
FIG. 12 is another view of the assembled fluid dispenser assembly in accordance with FIG. 1.

It is to be appreciated that in one embodiment, the wiper dial 302 can be used to control the amount of fluid material that is removed or remains on the brush when the applicator 200 is removed from the outer casing 300. With reference to FIGS. 4 and 12, when the fluid dispenser assembly is assembled, the outer surface 323 of the tapered end 326 of the wiper dial 302 is positioned adjacent the top surface 337 of the tapered wall 335 of the grommet 304. The wiper dial 302 can be adjustably moved over the grommet 304 and along the grooves of the dispensing chamber 306. Adjustment of the wiper dial 302 can cause the tapered end 326 of the wiper dial 302 to be moved further into or out of the funnel shaped opening 343 of the grommet 304 created by the tapered wall 335. As the wiper dial 302 is adjusted so as to allow for the tapered end 326 of the wiper dial 302 to further extend into the entrance 343 of the grommet, the opening 340 of the grommet 304 will be enlarged, thereby increasing the size of the second opening 319 of the dispensing chamber 306 of the outer casing 300. An enlarged opening 340 will allow the applicator brush 213 to more freely pass through the opening 340 of the grommet without contacting or minimally contacting the edges of the opening 340 of the grommet. This will allow more fluid material to remain on the applicator brush 213. In contrast, when the wiper dial is adjusted so to cause the tapered end 326 of the wiper dial to retract, the diameter of the opening 340 of the grommet 302 (and the overall second opening 319 of the dispensing chamber) will also be reduced. The reduced openings will cause more contact between the applicator and edge of the grommet, such that less fluid material will remain on the applicator brush 213 as the applicator 200 is removed from the outer casing 300. The wiper dial 302 can be adjusted such that if the tapered end of the wiper dial 302 is completely within the opening 335 of the grommet, the applicator brush 213 will contact the edges of the opening of the grommet 304.

It is to be appreciated that as previously discussed, in this embodiment, the combination of the wiper dial 302 and grommet 304 act as an adjustment mechanism. They cooperate to regulate the size of the overall second opening 319 of the dispensing chamber 306. It is to be therefore appreciated that there are numerous other arrangements for adjustment mechanisms that can be used to regulate the overall size of the second opening 319 of the dispensing chamber 306. In alternative embodiments, the grommet 304 and wiper dial 302 may be constructed and arranged as a single unit that regulates the opening 319 of the dispensing chamber 306. Similarly, other devices can be utilized that may function as an adjustment mechanism, that may include additional components.

The wiper dial 302 may alternatively include additional components that may help to further regulate the overall second opening 319 of the dispensing chamber 306. For example, the wiper dial 302 may include a mechanism that will help a user to better control how much the wiper dial 302 can be adjusted at any one time. In one embodiment, the wiper dial 302 may include a ratcheting mechanism or the like to help incrementally adjust the size of the opening 340 of the grommet 304 and the second opening of the dispensing chamber 306.

As the fluid material is expelled from the product container, the weight of the diaphragm 404 will cause the diaphragm 404 to push down upon the remaining fluid material in the product container 400 and to scrape the interior surface 453 of the hollow inner chamber 456 of the product container 400, such that a sufficient amount of fluid material will always be positioned adjacent the pump 402. The diaphragm 404 will continue to apply a force to the fluid material until the diaphragm 404 is directly adjacent the pump 402 and all of the fluid material within the product container is used.

Although the invention herein has been described with reference to particular embodiments, it is to be understood that these embodiments are merely illustrative of the principles and applications of the present invention. Although the presently disclosed embodiments are directed to a mascara dispensing device, it is to be understood that these dispensing devices may have a wide range of application, including, without limitation, other types of cosmetic or pharmaceutical dispensers. It is therefore to be understood that numerous modifications may be made to the illustrative embodiments and that other arrangements may be devised without departing from the spirit and scope of the present invention as defined by the appended claims.

The invention claimed is:

1. A device for applying a predetermined amount of fluid material to an applicator comprising:

an outer housing, the outer housing having a first chamber, a second chamber, an aperture at a second end of the outer housing, and a pump actuating surface between the first chamber and second chamber;

an adjustment mechanism associated with the aperture of the outer housing;

a fluid insert for housing the fluid material, the fluid insert having a first end and a second end, and the fluid insert capable of being arranged within the outer housing; and a pump attached to the second end of the fluid insert, the applicator being insertable into the second chamber of the outer housing through the opening in the outer housing, wherein movement of the fluid insert relative to the outer housing causes the pump to abut the pump actuating surface of the outer housing and to discharge a predetermined amount of fluid material into the second chamber, and wherein the adjustment mechanism regulates the amount of fluid on the applicator by adjusting a relative size of the aperture so as to interfere with the applicator upon removal of the applicator from the second chamber.

2. The device of claim 1, wherein the adjustment mechanism comprises an adjustment dial surrounding at least a portion of the outer housing.

3. The device of claim 2, wherein the adjustment dial is positioned within at least a portion of the outer housing, and wherein the adjustment dial is movable so as to regulate the size of the aperture of the outer housing.

4. The device of claim 3, wherein the adjustment dial includes wiping edges for contacting the edges of the applicator.

5. The device of claim 3, wherein the adjustment mechanism further comprises a grommet overlying the outer housing, the grommet having an opening aligned with the opening in the outer housing.

6. The device of claim 5, wherein the grommet is positioned between the adjustment dial and the outer housing.

7. The device of claim 6, wherein the adjustment dial further comprises an opening aligned with the grommet, wherein at least a portion of the adjustment dial can be positioned within the opening of the grommet so as to adjust the size of both the opening of the grommet and the opening of the outer housing.

8. The device of claim 1, wherein the first chamber of the outer housing is positioned adjacent the first end of the outer housing, and the second chamber is positioned adjacent the second end of the outer housing.

9. The device of claim 8, wherein the fluid insert is capable of being arranged within the first chamber of the outer housing.

10. The device of claim 1, further comprising a diaphragm for pushing fluid material in the fluid insert toward the pump positioned at the second end of the fluid insert.

11. A device for applying a predetermined amount of fluid material to an applicator comprising:

a fluid insert for housing fluid material having a first end, a second end, and a protruding ridge arranged on an exterior of the fluid insert between the first end and the second end;

a pump arranged at the second end of the fluid insert;

an outer housing having two interior chambers, one of the interior chambers receiving the fluid insert therein, the outer housing having a first end, a second end, a pump actuating surface positioned between the first and second ends, and an interior ridge arranged within the first chamber of the outer housing for securing the fluid insert therein when the protruding ridge of the fluid insert is positioned between the interior ridge of the outer housing and the second end of the outer housing;

an applicator insertable into the second chamber; and an adjustment mechanism for controlling the amount of fluid material that is on the applicator, the fluid insert constructed and arranged to be movable within the first chamber of the outer housing between a stationary position and an actuated position, the pump being in an extended position when the fluid insert is in the stationary position, and the pump being in a retracted position within the pump body as a result of the pump being in engagement with the pump actuating surface of the outer housing when the fluid insert is in the actuated position, and the pump being operative to dispense a predetermined amount of fluid material into the second chamber as the fluid insert is moved from the stationary position to the actuated position within the first chamber of the outer housing.

12. The device of claim 11, wherein the first interior chamber of the outer housing is positioned adjacent the first end of the outer housing, and the second interior chamber is positioned adjacent the second end of the outer housing.

13. The device of claim 11, wherein the adjustment mechanism further comprises an adjustment dial overlying at least a portion of the first end of the outer housing.

14. The device of claim 13, wherein the adjustment dial further includes wiping edges, the wiping edges of the adjustment dial being constructed and arranged to interfere with the applicator upon removal of the applicator from the second interior chamber, so as to regulate the amount of fluid material on the applicator.

15. The device of claim 14, wherein the adjustment mechanism further includes an opening and the outer housing includes an opening, wherein the opening of the adjustment mechanism and the opening of the outer housing are aligned.

16. The device of claim 15, wherein the opening of the outer housing is positioned at the second end of the outer housing.

17. The device of claim 13, wherein the adjustment mechanism further comprises a grommet positioned between the outer housing and the wiper dial, the grommet having an opening aligned with an opening in the outer housing.

18. The device of claim 17, wherein the grommet and adjustment dial cooperate to regulate the amount of fluid material on the applicator.

19. The device of claim 18, wherein at least a portion of the adjustment dial is movable within the grommet, the at least a portion of the adjustment dial capable of increasing or decreasing the size of the opening of the grommet.

20. A device for dispensing a predetermined amount of fluid material to an applicator comprising:

an outer housing having first and second ends, a first interior chamber, a second interior chamber, wherein the first interior chamber is adjacent the first end, and the second interior chamber is adjacent the second end, the first interior chamber including a first ridge and a second ridge displaced from the second end, and a recessed portion positioned between the first and second ridges;

a fluid insert for housing fluid material, the fluid insert having a raised ridge on a surface thereof, the fluid insert being constructed and arranged to fit within the first chamber of the outer housing so that the raised ridge can be arranged between the first and second ridges, the fluid insert being movable from a first position to a second position within the outer housing to disperse fluid material into the second interior chamber, the fluid insert being in a first position when the raised band is adjacent to the first ridge of the fluid insert, and the fluid insert being in a second position when the raised band is adjacent to the second ridge of the fluid insert; and an adjustment mechanism for regulating the amount of fluid material on the applicator, the adjustment device including an adjustment knob and a grommet, wherein the adjustment knob and grommet cooperate to regulate the size of the opening of the outer housing, the fluid insert dispensing the predetermined amount of fluid material contained in the fluid insert into the second interior chamber when the fluid insert moves from the first position to the second position.

21. The device according to claim 20, wherein the applicator is positioned within the first interior chamber, the applicator capable of applying the fluid material to a surface.

22. A device according to claim 20, wherein the adjustment knob includes an opening that is aligned with an opening of the grommet, the adjustment knob capable of moving from a first position to a second position, a first length of the adjustment knob being positioned within the opening of the grommet when the adjustment knob is in the first position, and a second length of the adjustment knob being positioned within the grommet when the knob is moved to a second position, the second length being greater in size than the first length, the adjustment knob increasing the size of the opening of the grommet when the adjustment knob moves from the first position to the second position.

23. The device according to claim 12, wherein the adjustment knob may be rotated about the outer housing to move the adjustment knob from the first position to the second position.

* * * * *